US007515842B2

(12) United States Patent
Takayanagi

(10) Patent No.: US 7,515,842 B2
(45) Date of Patent: Apr. 7, 2009

(54) IMAGE FORMING APPARATUS WITH RESISTANCE CONTROLLED TRANSFER MEMBER

(75) Inventor: Hiroki Takayanagi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 11/613,010

(22) Filed: Dec. 19, 2006

(65) Prior Publication Data

US 2007/0147861 A1 Jun. 28, 2007

(30) Foreign Application Priority Data

Dec. 22, 2005 (JP) ..... 2005-370165

(51) Int. Cl.
*G00G 15/00* (2006.01)

(52) U.S. Cl. ..... 399/45; 399/66; 399/313

(58) Field of Classification Search ..... 399/45, 399/66, 313

See application file for complete search history.

(56) References Cited

U.S. PATENT DOCUMENTS 6,600,895 B2 * 7/2003 Fletcher et al. ..... 399/307
2003/0185581 A1 * 10/2003 Hisada ..... 399/45

FOREIGN PATENT DOCUMENTS

| | | |
|---|---|---|
| JP | 04-318579 | 11/1992 |
| JP | 05-281859 | 10/1993 |
| JP | 09-146388 | 6/1997 |
| JP | 10-186895 | 7/1998 |

* cited by examiner

*Primary Examiner*—David M Gray
*Assistant Examiner*—Bryan Ready
(74) *Attorney, Agent, or Firm*—Canon USA Inc IP Div

(57) ABSTRACT

An image forming apparatus including an image bearing member for bearing a toner image and a contact transfer member. The contact transfer member has a temperature-dependent resistance value and contacts the image bearing member. The contract transfer member is applied with a voltage so as to transfer the toner image on the image bearing member to a transfer material, wherein the contact transfer member is heated or cooled in such a way that the resistance value of the contact transfer member is changed in response to the type of the transfer material.

4 Claims, 8 Drawing Sheets

IMAGE FORMING APPARATUS WITH RESISTANCE CONTROLLED TRANSFER MEMBER

BACKGROUND OF THE INVENTION

1. Field of the Invention

The present invention relates to an image forming apparatus including a contact transfer member which contacts an image bearing member, so as to transfer a toner image on the image bearing member to a transfer material. In particular, it relates to an image forming apparatus capable of changing the condition of the transfer member in response to the type of the transfer material.

2. Description of the Related Art

A contact transfer member, which contacts an image bearing member so as to transfer a toner image on the image bearing member to a transfer material, has an advantage that the conveyance of the transfer material during transfer is stabilized and has been used widely.

However, in the case where the contact transfer member is used, the following problems occur.

The optimum relationship between a transfer voltage applied to the contact transfer member and a transfer current passing the contact transfer member when the transfer voltage is applied varies depending on the type of transfer material. Therefore, appropriate transfer may not be performed depending on the type of transfer material.

That is, in the case where the length in a direction orthogonal to the conveyance direction (hereafter referred to as "width direction") of a transfer material to be used is short, the transfer current concentrates on a non-paper-passing portion of a transfer portion, the transfer current passing a paper-passing portion becomes insufficient, and a toner image is not satisfactorily transferred. In the case where cardboard is used, as shown in FIG. 9, when a part of the front-end portion of the transfer material enters the transfer portion, the transfer current concentrates on a portion, in which no transfer material is present, of a transfer portion, the transfer current passing the transfer material becomes insufficient, and a toner image is not satisfactorily transferred to the front-end portion. In these cases, it is better that the resistance of the contact transfer member becomes higher.

On the other hand, in the case where the length in the width direction of the transfer material to be used is long, the problem hardly occurs in that the transfer current passing the transfer material becomes insufficient due to concentration of the transfer current on the non-paper-passing portion. In this case, since the voltage applied to the contact transfer member during the transfer can be decreased, it is better that the resistance of the contact transfer member becomes lower.

For the configuration to overcome the above-described problems, Japanese Patent Laid-Open No. 5-281859 discloses a transfer belt which contacts an image bearing member and which is provided with a high resistance portion and a low resistance portion in the direction of rotation.

However, if the configuration, in which the high resistance portion and the low resistance portion are disposed in the contact transfer member and are switched in response to the type of the transfer material, is used, there is a problem in that the image forming apparatus is upsized.

SUMMARY OF THE INVENTION

The present invention is directed to an image forming apparatus capable of changing the resistance of a contact transfer member without upsizing the image forming apparatus.

According to one aspect of the present invention, an image forming apparatus includes an image bearing member configured to bear a toner image, and a contact transfer member having a temperature-dependent resistance value and contacting the image bearing member. The contact transfer member is applied with a voltage so as to transfer the toner image on the image bearing member to a transfer material. The apparatus also includes a resistance value changing unit configured to heat or cool the contact transfer member in such a way that the resistance value of the contact transfer member is changed in accordance with the type of the transfer material.

Further features of the present invention will become apparent from the following description of exemplary embodiments with reference to the attached drawings.

DESCRIPTION OF THE EMBODIMENTS

First Embodiment

An embodiment according to the present invention will be described below with reference to the drawings.

Figure 2:
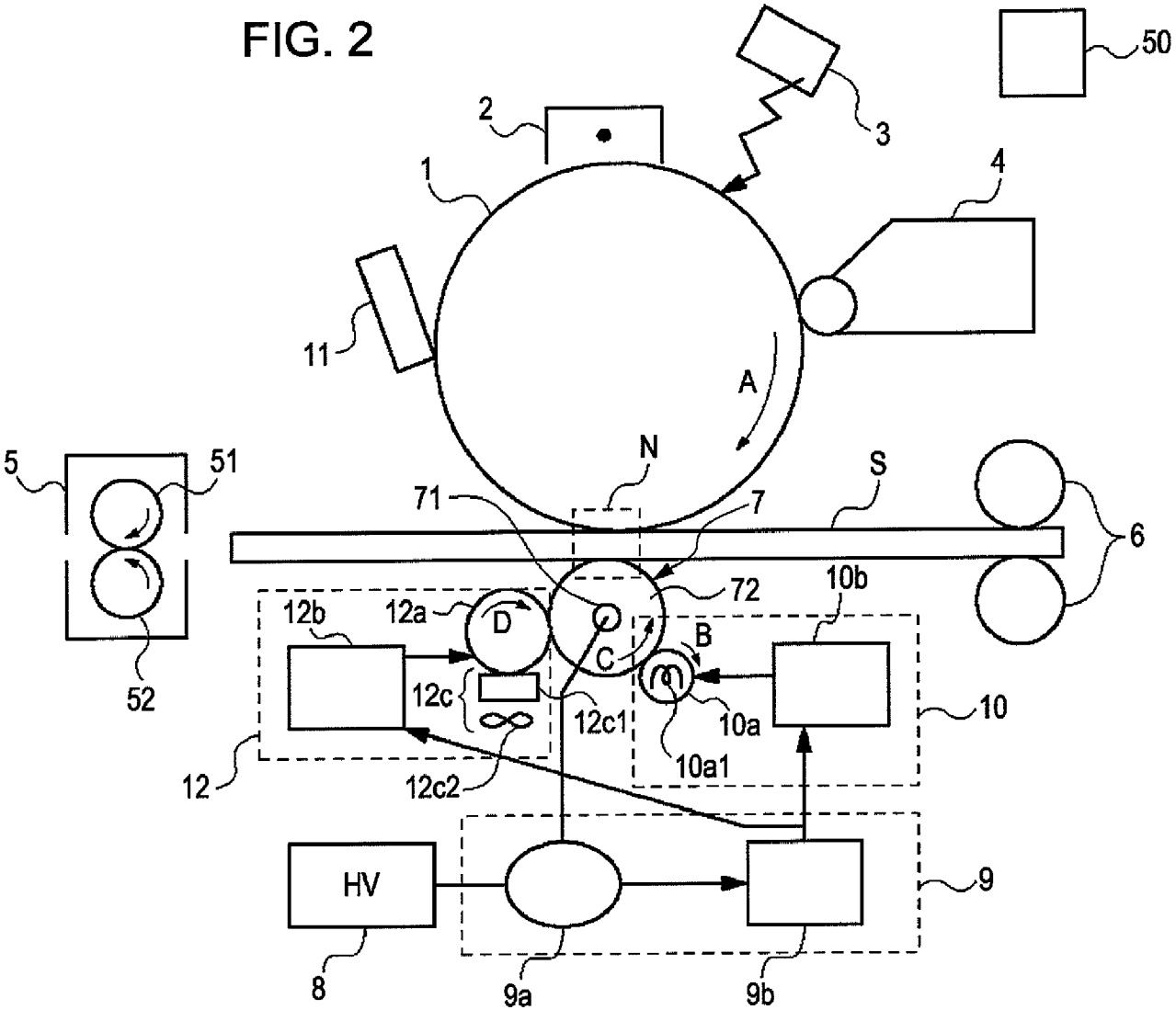
FIG. 2 is a schematic sectional view of an image forming apparatus in which the temperature control according to any one of the first to fourth embodiments is used.

FIG. 2 shows an example of an image forming apparatus according to the first embodiment. The image forming apparatus shown in FIG. 2 is provided with a drum type electrophotographic photosensitive member (hereafter referred to as "photosensitive drum") 1 serving as an image bearing member. The photosensitive drum 1 is driven to rotate by a driving unit (not shown in the drawing) in a clockwise direction as shown in FIG. 2 (indicated by an arrow A in the drawing). The surface of the photosensitive drum 1 driven to rotate is uniformly charged by a charging apparatus (charging unit) 2, and is irradiated with laser light from an exposure apparatus (electrostatic image forming unit) 3 in response to an image signal, so that an electrostatic latent image is formed. The resulting electrostatic latent image is developed as a toner image by a developer (developing unit) 4. A transfer material S is conveyed by resist rollers 6 in such a way as to be timed to the toner image on the photosensitive drum 1. The transfer material S is pressed between the photosensitive drum 1 and a transfer roller (contact transfer member) 7 disposed opposing to the photosensitive drum 1. A transfer bias having a polarity opposite to the toner charge is applied to the transfer roller 7 by a transfer power supply 8 and, thereby, the toner image on the photosensitive drum 1 is transferred to the transfer material S in a transfer portion N. The transfer roller 7 is rotated in a direction indicated by an arrow C shown in the drawing. After the toner image is transferred, the transferred toner remaining on the surface of the photosensitive drum 1 is removed by a cleaner 11, and the photosensitive drum 1 is used for next film formation.

On the other hand, after the toner image is transferred, the transfer material in the state of bearing the unfixed toner image is driven by the transfer roller 7 and is conveyed to a fuser 5 through a conveying guide, although not shown in the drawing. The fuser 5 heats and fuses the toner image on the surface, and the toner image is fixed to the transfer material S. The fuser 5 is composed of a fixing roller 51 including a heater (not shown in the drawing) and a pressure roller 52 constituting a nip portion together with the fixing roller 51. The periphery of the fixing roller 51 is kept at about 165° C.

In the case where normal paper (basis weight: 160 g/m$^2$ or less) is used as the transfer material S, the conveying speed of the transfer material S conveyed by the resist rollers 6, the transfer roller 7, and the photosensitive drum 1 in the transfer portion N is about 260 mm/sec. In the transfer portion N, the movement speed of the transfer material S is equal to that of the surface of the photosensitive drum 1. Hereafter, the conveying speed refers to the movement speed of the transfer material S and the surface of the photosensitive drum 1 in the transfer portion N. In the case where specialty paper, e.g., embossed paper or cardboard (basis weight: more than 160 g/m$^2$), is used as the transfer material S, the conveying speed is decreased to about 130 mm/sec.

The transfer roller 7 has an outer diameter of about 16 mm and is composed of a metal core bar 71 having an outer diameter of about 8 mm and an electroconductive material layer 72, which is an elastic layer and is disposed on the peripheral surface of the core bar. The electroconductivity of this electroconductive material layer 72 is adjusted in a middle resistance region of 1 MΩ to 100 MΩ by using a polymer elastomer or a polymer foam material, e.g., rubber or urethane, as a base material and blending an ionic electroconductive material therein. For urethane used as the base material of the above-described electroconductive material layer 72, polyol to be used for preparing general soft polyurethane foam or urethane elastomer is used as a polyhydroxyl compound. That is, examples thereof include polyether polyol, polyester polyol, each having a polyhydroxyl group at a terminal, and polyether polyol produced by copolymerization of the two. Furthermore, general polyols, e.g., so-called polymer polyols produced by polymerization of ethylenic unsaturated monomer in polyol, can be used. For a polyisocyanate compound, polyisocyanate similarly used for preparing general soft polyurethane foam or urethane elastomer is used. That is, examples thereof include tolylene diisocyanate (TDI), crude TDI, 4,4-diphenylmethane diisocyanate (MDI), and crude MDI. Furthermore, aliphatic polyisocyanate having the carbon number of 2 to 18, alicyclic polyisocyanate having the carbon number of 4 to 15, and mixtures or modified products of these polyisocyanates can also be used. For example, prepolymers produced by a partial reaction with polyols are used. For the rubber used as the base material of the above-described electroconductive material layer 72, natural rubber, nitrile butadiene rubber, or chloroprene rubber can be used. Furthermore, common rubber, e.g., styrene butadiene rubber, butadiene rubber, ethylene propylene rubber, isoprene rubber, or polynorbornene rubber, can be used. Alternatively, thermoplastic rubber, e.g., styrene-butadiene-styrene (SBS) or a hydrogenated product of styrene-butadiene-styrene (SEBS), can be used. Liquid polyisoprene rubber can also be blended into the above-described rubber.

In addition, a foamed product of, for example, copolymerization rubber of the above-described rubber or epichlorohydrin and ethylene oxide can also be used. Examples of ionic electroconductive materials added to the base materials include inorganic ionic electroconductive materials, e.g., sodium perchlorate, calcium perchlorate, and sodium chloride. Furthermore, examples thereof include organic ionic electroconductive materials, e.g., modified aliphatic dimethylethyl ammonium ethosulfate, stearylammonium acetate, laurylammonium acetate, and octadecyltrimethylammonium perchlorate. In general, sodium perchlorate is frequently used.

A metal roller (heating member) 10*a*, which is a constituent member of a heating portion 10 for heating the transfer roller 7, has a cylindrical shape and is driven to rotate by the transfer roller 7 in a direction indicated by an arrow B shown in the drawing. The metal roller 10*a* is heated to 0 to 45° C. by a halogen lamp heater 10*a*1 in the cylinder. Both end portions of the metal roller 10*a* are supported by insulating members formed from polyoxymethylene (POM) or the like. The metal roller 10*a* is formed to have the same length as the length of the electroconductive material layer 72 of the transfer roller 7, and the POM support members at both end portions are energized toward the transfer roller 7 by contact units (not shown in the drawing).

At this time, a load of 200 g is imposed on each side in such a way that the contact pressure relative to the transfer roller 7 becomes uniform in a longitudinal direction thereof. The metal roller 10*a* is driven to rotate in a direction indicated by an arrow B by the rotation of the transfer roller 7. The repetition of turning on and turning off of the above-described halogen lamp heater 10*a*1 is controlled by a heating controller 10*b* in such a way that the temperature of the metal roller 10*a* can be changed. The material of the metal roller 10*a* is not limited to aluminum, but may be other arbitrary metals (for example, copper), as long as the metal has a high thermal conductivity. The material for the shaft flange is not simply limited to POM, but may be any material, for example, a mixed material of nylon and glass, as long as the material has an insulating property.

An output detection portion 9 of the transfer power supply 8 detects a current passing the transfer roller 7 by a current detector 9*a* when a voltage of +1 kV, which is a monitor voltage, is applied to the transfer roller 7 in the state in which the transfer material S is not present in the transfer portion N. This is carried out 8 times per rotation of the transfer roller 7, and the eight results of current detection are averaged by an arithmetic apparatus 9*b*. Subsequently, an impedance I of the transfer portion N is calculated by dividing the value of the monitor voltage by the current detection result. The temperature of the metal roller 10*a* is controlled by controlling the turning on and the turning off of the halogen lamp heater 10*a*1 with the above-described heating controller 10*b* in such a way that the impedance I becomes 60 to 100 MΩ. This impedance I is for preventing occurrence of a poor image even when the conveying speed of normal paper is set at 260 mm/sec.

The transfer bias (output) by the transfer power supply 8 is constant-voltage controlled in such a way that 40 to 70 μA of current passes when normal paper with no transferred toner image passes through the transfer portion N in a temperature and humidity environment of 23° C. and 50%. A metal roller 12*a*, which is a constituent member of a cooling portion 12 for cooling the transfer roller 7, has a cylindrical shape and is driven to rotate by the transfer roller 7 in a direction indicated by an arrow D. The metal roller 12*a* is cooled to 0 to 10° C. from the outside by, for example, an air-cooled type cooling control member 12*c* including a Peltier element 12*c*1 and a fan 12*c*2. Here, the low-temperature side of the Peltier element 12*c*1 is in contact with the metal roller (cooling member) 12*a*, and the high-temperature side is cooled by receiving wind from the fan 12*c*2. Both end portions of the metal roller 12*a* are supported by insulating members formed from polyoxymethylene (POM) or the like. The metal roller 12*a* is formed to have the same length as the length of the electroconductive material layer 72 of the transfer roller 7, and the POM support members at both end portions are energized toward the transfer roller 7 by contact units (not shown in the drawing). At this time, a load of 200 g is imposed on each side in such a way that the contact pressure relative to the transfer roller 7 becomes uniform in a longitudinal direction thereof. The metal roller 12*a* is driven to rotate in a direction indicated by the arrow D by the rotation of the transfer roller 7. The temperature of the metal roller 12*a* can be changed by repeating ON/OFF of the Peltier element 12*c*1 and the fan 12*c*2 based on input signals into the above-described cooling controller 12*b*. The material of the metal roller 12*a* is not limited to aluminum, but may be other arbitrary metals (for example, copper), as long as the metal has a high thermal conductivity. The material for the shaft flange is not simply limited to POM, but may be any material, for example, a mixed material of nylon and glass, as long as the material has an insulating property. A resistance value changing unit, which cools or heats the transfer roller 7 to change the resistance value of the transfer roller 7, is formed by the cooling portion 12 and the heating portion 10.

The temperature of the metal roller 12*a* is controlled by controlling the ON/OFF of the Peltier element 12*c*1 and the fan 12*c*2 with the above-described cooling controller 12*b* in such a way that the impedance I becomes 110 to 220 MΩ. This value of impedance I is for preventing occurrence of a poor image at a front end and a rear end of specialty paper when the specialty paper, e.g., embossed paper, is continued to convey at 130 mm/sec.

The transfer bias (output) by the transfer power supply 8 is constant-voltage controlled in such a way that 15 to 30 μA of current passes when specialty paper with no toner image passes through the transfer portion N in a temperature and humidity environment of 23° C. and 50%.

Figure 7A:
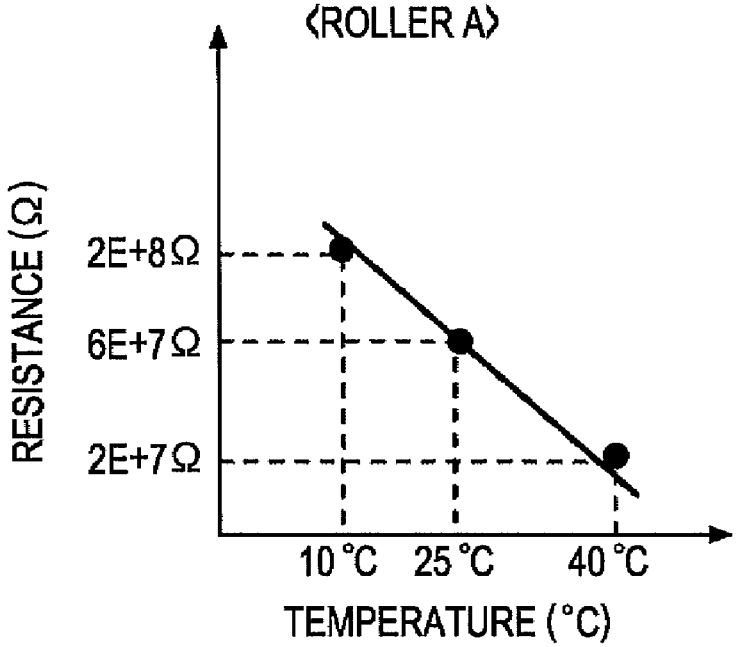
FIGS. 7A and 7B are diagrams showing resistance value versus temperature of contact transfer members used in the first to fifth embodiments.
Figure 7B:
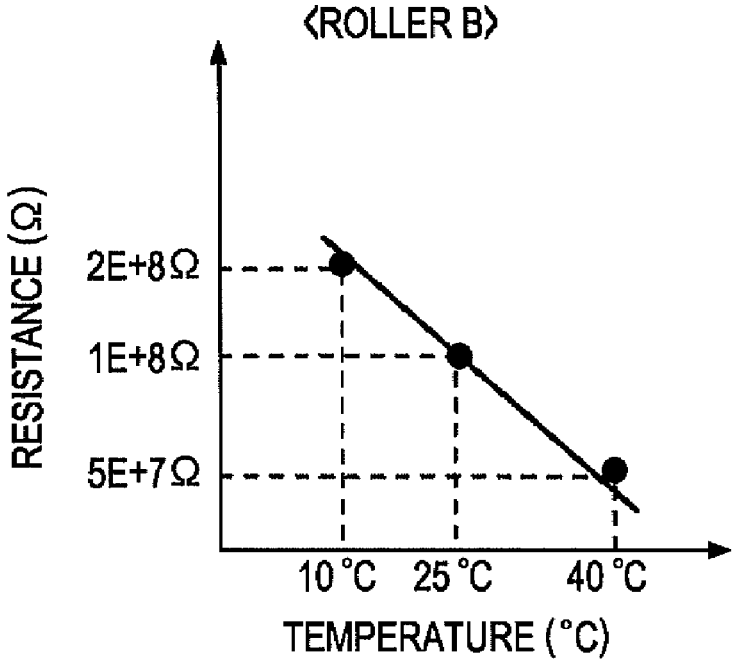
Figure 8:
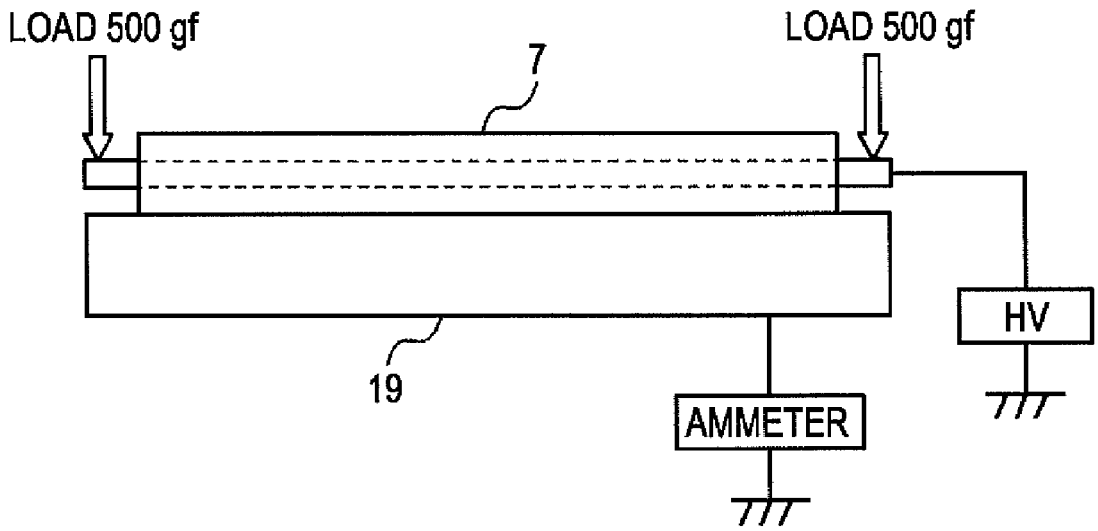
FIG. 8 is a diagram for explaining a method for measuring the resistance value of a contact transfer member.
Figure 9:
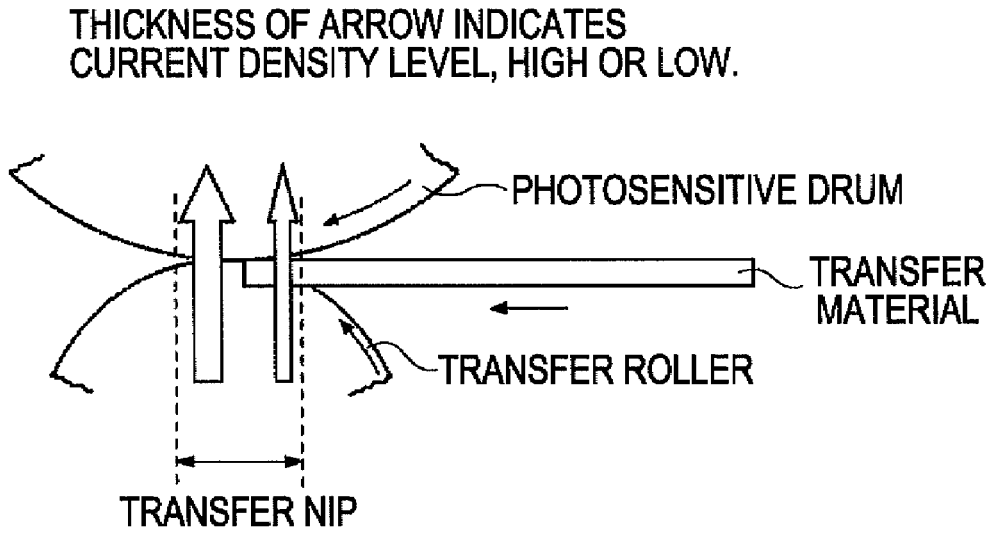
FIG. 9 is a diagram for explaining a problem to be solved by the present invention.

FIGS. 7A and 7B show the relationships between the temperature and the resistance of two types of transfer rollers used in the present embodiment and second to fifth embodiments described below. A roller A has a resistance suitable for transfer to the normal paper at ambient temperature (25° C.). On the other hand, a roller B has a resistance suitable for transfer to the specialty paper. FIG. 8 is a schematic diagram showing the measurement of the resistance of the transfer roller. The resistance value of the transfer roller 7 exhibits temperature dependence.

A load of 500 gf is imposed on each of core bars at two end portions of the transfer roller 7, a metal cylinder 19 is rotated at a peripheral speed of 24 mm/sec and, thereby, the transfer roller 7 is driven to rotate.

The core bar of the transfer roller 7 is applied with +2,000 V by a high voltage power supply HV, the current, which passes at that time, is measured with an ammeter and, thereby, the resistance is determined. The resistance value refers to a value determined by dividing the applied voltage by the measured current.

The temperature control operation of the transfer roller 7 in the present embodiment will be described below. In the present embodiment, a roller B shown in FIG. 7B is used.

Figure 1:
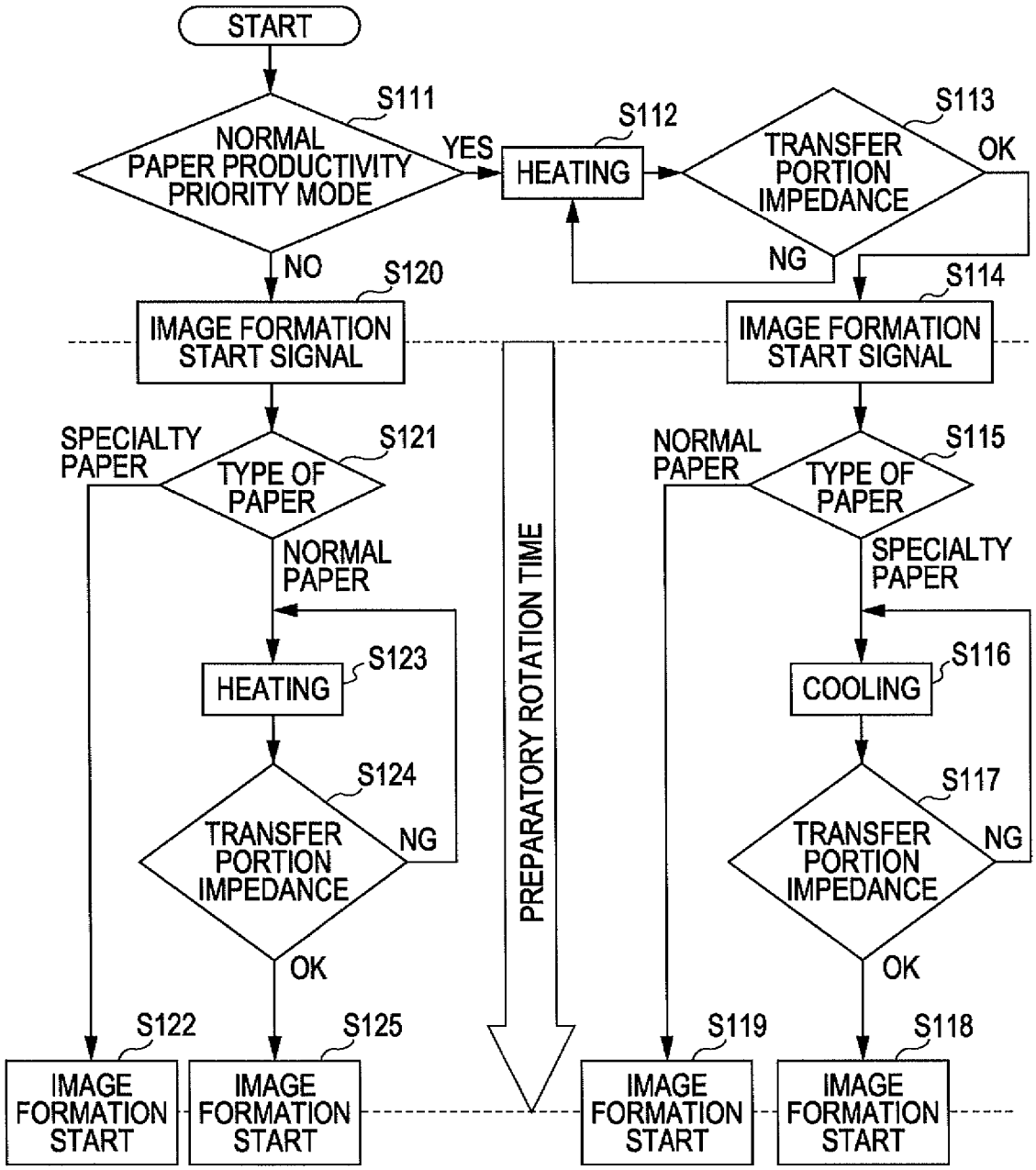
FIG. 1 is a flow diagram for explaining the temperature control operation according to a first embodiment.

The control method will be described below. As shown in FIG. 1, it is determined whether the selection of a normal paper productivity priority mode is necessary or not (S111). The normal paper productivity priority mode is a mode suitable for the case where the normal paper is frequently used as compared with the specialty paper.

A sequence in the case where the normal paper productivity priority mode is selected will be described. In the case where the normal paper productivity priority mode is selected, the resistance of the transfer roller 7 is adjusted to become suitable for image formation on the normal paper during image forming apparatus warm-up rotation before an image formation start signal is received (during standby of the image forming apparatus). At this time, the resistance of the transfer roller 7 is adjusted at 5E+7Ω.

That is, the image forming apparatus is on standby while the impedance I of the transfer portion N is adjusted at the value suitable for the normal paper. This adjustment is performed in such a way that the heating controller 10*b* heats the transfer roller 7 with the metal roller 10*a* so as to decrease the resistance. The impedance I of the transfer portion N in the state, in which the transfer material S is not present in the transfer portion N, is adjusted at a desired value (in the present embodiment, 60 to 100 MΩ, conveying speed 260 mm/sec). When the image formation start signal is received, the step of forming an image is controlled based on the information of paper type input by the user from an operation panel (transfer material type input unit) 50.

When the normal paper is selected, since the resistance of the transfer roller 7 has already become suitable for the normal paper, the image formation is started immediately.

On the other hand, when the specialty paper is selected, the resistance of the transfer roller 7 is changed from the value suitable for the normal paper to 2E+8Ω suitable for the specialty paper and, thereafter, the image formation is started. The cooling controller 12*b* controls in such a way that the transfer roller 7 is cooled with the metal roller 12*a*. Consequently, the impedance I of the transfer portion N is adjusted at a desired value (in the present embodiment, 110 to 220 MΩ, conveying speed 130 mm/sec). A flow in the case where the normal paper productivity priority mode is selected will be described with reference to the chart as shown in FIG. 1. The transfer roller 7 is heated (S112). The impedance of the transfer portion is measured (S113). When the impedance of the transfer portion is not within the rang of 60 to 100 MΩ, the transfer roller 7 is heated again (S112). When the impedance of the transfer portion is within the rang of 60 to 100 MΩ, an image formation signal is output (S114). Subsequently, it is determined whether the paper, on which the image is to be formed, is the normal paper or the specialty paper (S115). When the paper is the normal paper, the transfer roller 7 is cooled (S116). Thereafter, the impedance of the transfer portion is measured (S117). When the impedance of the transfer portion is not within the range of 110 to 220 MΩ, the transfer roller 7 is heated again (S116). When the impedance of the transfer portion is within the rang of 110 to 220 MΩ, the image formation is started (S117). When the paper is determined to be the normal paper in S115, the image formation is started immediately (S118).

A sequence in the case where the normal paper productivity priority mode is not selected will be described. In this case, the resistance adjustment of the transfer roller 7 is not performed during standby of the image forming apparatus. The resistance of the transfer roller 7 is a value suitable for the specialty paper at ambient temperature. When the image formation start signal is received, the step of forming an image is controlled based on the information of paper type input by the user. When the specialty paper is selected, since the resistance of the transfer roller 7 is suitable for the specialty paper, the image formation is started immediately.

On the other hand, when the normal paper is selected, the heating controller 10*b* controls in such a way that the transfer roller 7 is heated with the metal roller 10*a*. Consequently, the impedance I of the transfer portion N in the state, in which the transfer material S is not present in the transfer portion N, is adjusted at a desired value (in the present embodiment, 60 to 100 MΩ, conveying speed 130 mm/sec).

Subsequently, the image formation is started. When the image formation start signal is received, the image formation is started (preparatory rotation), and the time until the paper is output is a waiting time of the user. A flow in the case where the normal paper productivity priority mode is not selected will be described with reference to the chart as shown in FIG. 1. An image formation signal is output (S120). Subsequently, it is determined whether the paper, on which the image is to be formed, is the normal paper or the specialty paper (S121). When the paper is determined to be the specialty paper, the image formation is started immediately (S122). When the paper is determined to be the normal paper, the transfer roller 7 is heated (S123). The impedance of the transfer portion is measured (S124). When the impedance of the transfer portion is not within the rang of 60 to 100 MΩ, the flow returns to S123 again, and the transfer roller 7 is heated. When the impedance of the transfer portion is within the rang of 60 to 100 MΩ, the image formation is started immediately (S125).

As described above, the impedance I of the transfer portion N is adjusted at a value suitable for the normal paper in advance during the warm-up rotation and, thereby, the time required for the preparatory rotation can be decreased and the productivity of the normal paper can be improved.

When the productivity of the specialty paper is given a high priority, the image formation can be started immediately without performing heating to decrease the impedance I of the transfer portion N during the preparatory rotation (when heating is performed, a cooling process is required for the specialty paper and, therefore, the preparatory rotation time is increased, correspondingly).

In this manner, the image formation start timing is determined in response to the type of transfer material S and the detection result of the impedance I of the transfer portion N.

Second Embodiment

The present embodiment is different from the first embodiment in the temperature control operation of the transfer roller 7. The other configuration is the same as that in the first embodiment. In the present embodiment, the roller A having the resistance suitable for the normal paper, as shown in FIG. 7A, is used.

Figure 3:
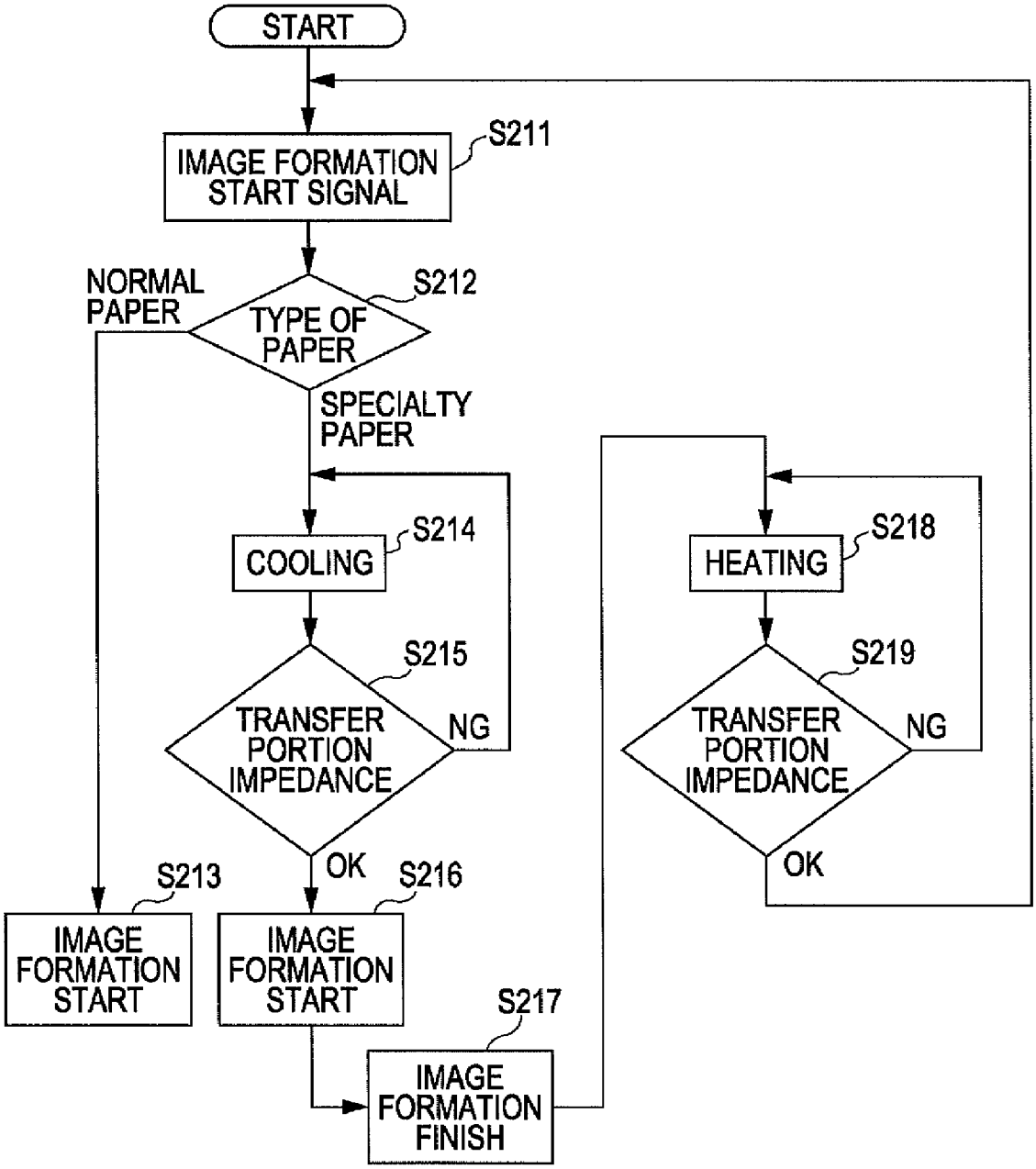
FIG. 3 is a flow diagram for explaining the temperature control operation according to the second embodiment.

As shown in FIG. 3, when the image formation start signal is received, the step of forming an image is controlled based on the information of paper type input by the user from the panel 50.

When the normal paper is selected, since the resistance value of the transfer roller 7 is 6E+7Ω suitable for the normal paper at ambient temperature, the image formation is started immediately at a conveying speed of 260 mm/sec.

On the other hand, when the specialty paper is selected, the cooling controller 12*b* controls in such a way that the transfer roller 7 is cooled with the metal roller 12*a*, and the resistance of the transfer roller is changed to 2E+8Ω.

Consequently, the impedance I of the transfer portion N in the state, in which the transfer material S is not present in the transfer portion N, is adjusted at a desired value (in the present embodiment, 110 to 220 MΩ, conveying speed 130 mm/sec).

Subsequently, the image formation is started. When the image formation is finished, the heating controller 10*b* controls in such a way that the transfer roller 7 is heated with the metal roller 10*a*, and the resistance of the transfer roller 7 is returned to 6E+7Ω suitable for the transfer to the normal paper. The impedance I of the transfer portion N in the state, in which the transfer material S is not present in the transfer portion N, is adjusted at a desired value (in the present embodiment, 60 to 100 MΩ, conveying speed 130 mm/sec). Thereafter, the image forming apparatus is set on standby for an image formation start signal. A flow of the present example will be described with reference to the flow chart as shown in FIG. 3. An image formation signal is output (S211). Subsequently, the type of paper, on which the image is to be formed, is determined (S212). When the paper, on which the image is to be formed, is determined to be the normal paper, the image formation is started immediately (S213). When the paper, on which the image is to be formed, is determined to be the specialty paper, the transfer roller 7 is cooled (S214). The impedance of the transfer portion is measured (S215). When the impedance is not within the rang of 60 to 100 MΩ, the flow returns to S214, and the transfer roller 7 is cooled again. When the impedance is within the rang of 110 to 220 MΩ, the image formation is started immediately (S216). When the image formation is finished (S217), the transfer roller 7 is heated again (S218). Thereafter, the impedance of the transfer portion is measured (S219). When the impedance of the transfer portion is not within the rang of 60 to 110 MΩ, the flow returns to S218, and the transfer roller 7 is heated (S218). When the impedance of the transfer portion is within the rang of 60 to 110 MΩ, the image forming apparatus is set on standby.

In this manner, the image formation start timing is determined in response to the type of transfer material S and the detection result of the impedance I of the transfer portion N.

Third Embodiment

The present embodiment is different from the first embodiment in the temperature control operation of the transfer roller 7. The other configuration is the same as that in the first embodiment. In the present embodiment, the roller B shown in FIG. 7B is used.

In the temperature control operation of the present embodiment, when the normal paper productivity priority mode (conveying speed is 260 mm/sec) is selected, prior to the start of the image formation, the transfer roller 7 is adjusted at 40° C., and the resistance is adjusted at 5E+7Ω. When the normal paper productivity priority mode is not selected (conveying speed is 130 mm/sec), the resistance adjustment of the transfer roller 7 prior to the image formation is not performed. In the case where a transfer material S having a length in a direction orthogonal to the conveyance direction is at the maximum size (width 297 mm) is used, the transfer roller is adjusted at 40° C., and the resistance is adjusted at 5E+7Ω. When a transfer material S having a size other than the maximum is used, for example, when the width is 210 mm, the transfer roller is adjusted at 10° C., and the resistance is adjusted at 2E+8Ω.

Figure 4:
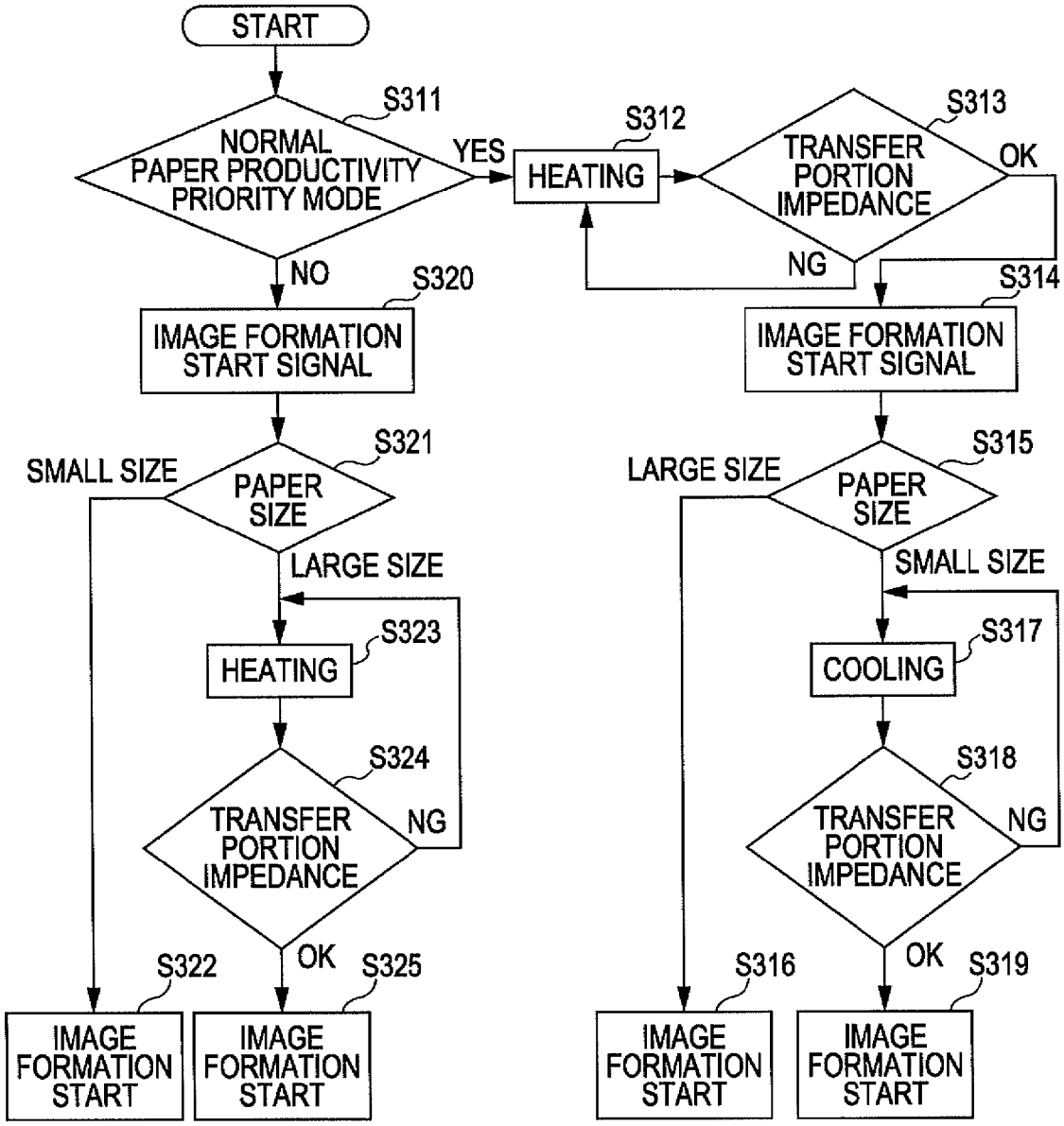
FIG. 4 is a flow diagram for explaining the temperature control operation according to the third embodiment.

For details, as shown in FIG. 4, it is determined whether the normal paper productivity priority mode is selected or not. When the normal paper priority mode is used, the heating controller 10*b* controls in such a way that the transfer roller 7 is heated with the metal roller 10*a*, so as to decrease the resistance of the transfer roller 7. Consequently, the impedance I of the transfer portion N in the state, in which the transfer material S is not present in the transfer portion N, is adjusted at a desired value (in the present embodiment, 60 to 100 MΩ, conveying speed 130 mm/sec).

When the image formation start signal is received, the step of forming an image is controlled based on the information of paper size input by the user from the operation panel 50.

When a transfer material S (large size), the length of which is long in a direction orthogonal to the conveyance direction, is used, the image formation is started immediately.

When a transfer material S (small size), the length of which is short in a direction orthogonal to the conveyance direction, is used, the cooling controller 12*b* controls in such a way that the transfer roller 7 is cooled with the metal roller 12*a*, so as to increase the resistance of the transfer roller 7. Consequently, the impedance I of the transfer portion N in the state, in which the transfer material S is not present in the transfer portion N, is adjusted at a desired value (in the present embodiment, 110 to 220 MΩ, conveying speed 130 mm/sec).

Thereafter, the image formation is started.

In the case where the normal paper productivity priority mode is not selected, when the image formation start signal is received, the step of forming an image is controlled based on the information of paper size input by the user. A flow of the present example will be described with reference to the flow chart as shown in FIG. 4. It is determined whether the normal paper productivity priority mode is selected or not (S311). When the normal paper productivity priority mode is selected, the transfer roller 7 is heated (S312). Subsequently, the impedance of the transfer portion is measured (S313). When the impedance of the transfer portion is not within the rang of 60 to 100 MΩ, the flow returns to S312, and the transfer roller 7 is heated again. When the impedance of the transfer portion is within the rang of 60 to 100 MΩ, the image formation start signal is output (S314). Thereafter, the size of the paper, on which the image is to be formed, is determined (S315). When the paper is of large size, the image formation is started immediately (S316). When the paper is of small size, the transfer roller 7 is cooled (S317). Subsequently, the impedance of the transfer portion is measured (S318). When the impedance of the transfer portion is not within the rang of 110 to 220 MΩ, the transfer roller 7 is cooled again (S317). When the impedance of the transfer portion is within the rang of 110 to 220 MΩ, the image formation is started (S319). When the normal paper productivity priority mode is not selected in S311, the image formation start signal is output (S320). Thereafter, the size of the paper is determined (S321). When the paper is of small size, the image formation is started immediately (S322). When the paper is of large size, the transfer roller 7 is heated (S323). Subsequently, the impedance of the transfer portion is measured (S324). When the impedance of the transfer portion is not within the rang of 60 to 110 MΩ, the flow returns to S323, and the transfer roller 7 is heated again. When the impedance of the transfer portion is within the rang of 60 to 110 MΩ, the image formation is started (S325).

When a transfer material S (small size), the length of which is short in a direction orthogonal to the conveyance direction, is used, the image formation is started immediately.

On the other hand, when a transfer material S (large size), the length of which is long in a direction orthogonal to the conveyance direction, is used, the heating controller 10*b* controls in such a way that the transfer roller 7 is heated with the metal roller 10*a*. Consequently, the impedance I of the transfer portion N in the state, in which the transfer material S is not present in the transfer portion N, is adjusted at a desired value (in the present embodiment, 60 to 100 MΩ, conveying speed 130 mm/sec).

Thereafter, the image formation is started.

Here, the length in the direction orthogonal to the conveyance direction of the transfer material is input from the operation panel 50. Alternatively, the length can be detected by a transfer material size detection unit (not shown in the drawing) by using a line sensor or the like.

In this manner, the image formation start timing is determined in response to the transfer material size, that is, the length of the transfer material in the direction orthogonal to the conveyance direction, and the detection result of the impedance I of the transfer portion N.

Fourth Embodiment

The present embodiment is different from the first embodiment in the temperature control operation of the transfer roller 7. The other configuration is the same as that in the first embodiment. In the present embodiment, the roller A shown in FIG. 7A is used.

In the temperature control operation of the present embodiment, in the case where a transfer material having a length in a direction orthogonal to the conveyance direction is at the maximum (width 297 mm) is used, the transfer roller is adjusted at 25° C., and the resistance is adjusted at 6E+7Ω.

On the other hand, when a transfer material having a length other than the maximum, for example, a width of 210 mm, is used, the transfer roller is adjusted at 10° C., and the resistance is adjusted at 2E+8Ω.

Figure 5:
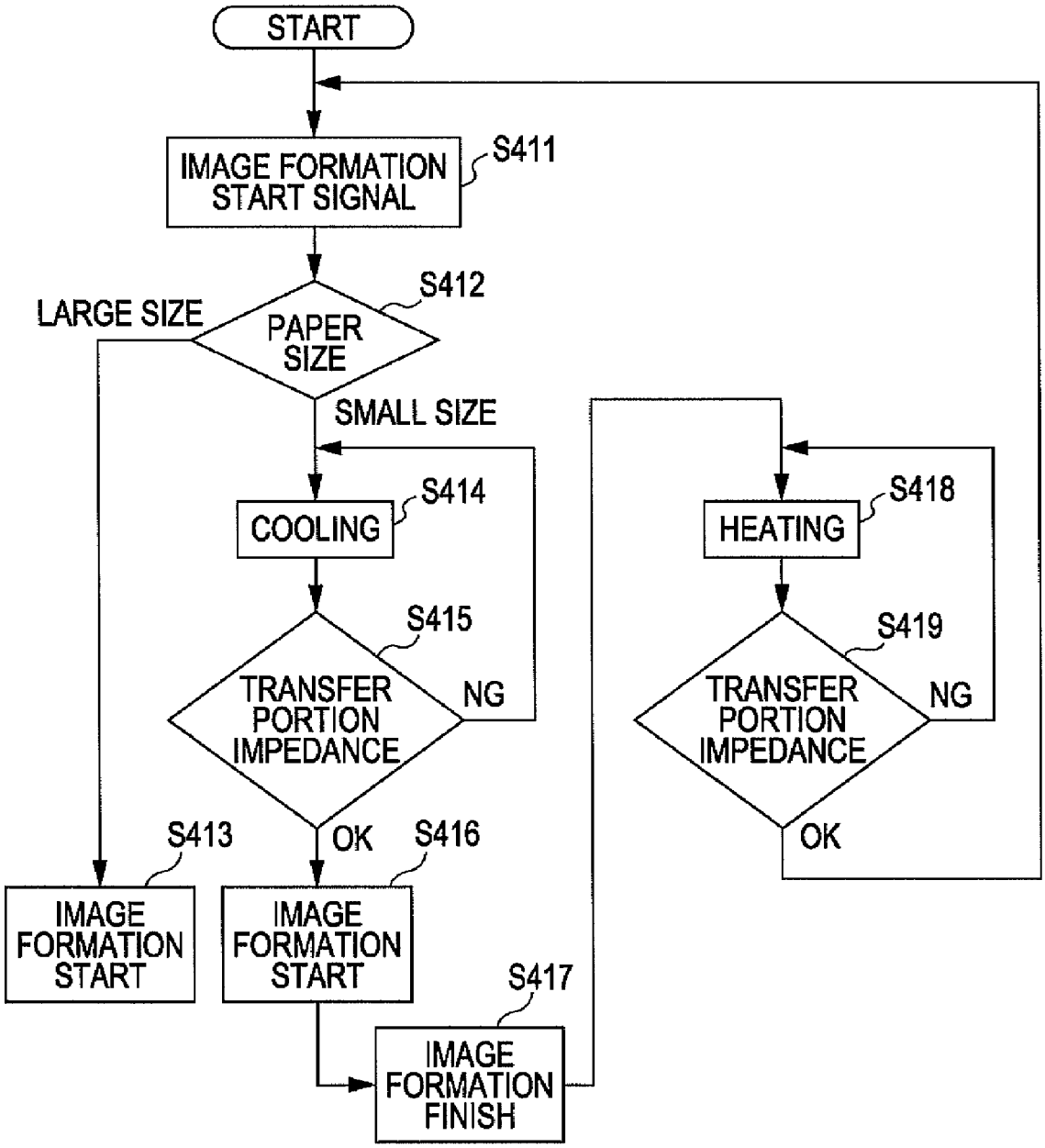
FIG. 5 is a flow diagram for explaining the temperature control operation according to the fourth embodiment.

For details, as shown in FIG. 5, when the image formation start signal is received, the step of forming an image is controlled based on the information of paper size input by the user from the operation panel.

When a transfer material S, the length of which is long in a direction orthogonal to the conveyance direction, is used, the image formation is started immediately at a conveying speed of 260 mm/sec.

When a transfer material S, the length of which is short in a direction orthogonal to the conveyance direction, is used, the cooling controller 12*b* cools the transfer roller 7. Consequently, the impedance I of the transfer portion N in the state, in which the transfer material S is not present in the transfer portion N, is adjusted at a desired value (in the present embodiment, 110 to 220 MΩ, conveying speed 130 mm/sec). Thereafter, the image formation is started.

When the image formation is finished, the heating controller 10*b* controls in such a way that the transfer roller 7 is heated with the metal roller 10*a*. Consequently, the impedance I of the transfer portion N in the state, in which the transfer material S is not present in the transfer portion N, is adjusted at a desired value (in the present embodiment, 60 to 100 MΩ, conveying speed 130 mm/sec). Thereafter, the image forming apparatus becomes on standby for an image formation start signal. A flow of the present example will be described with reference to the flow chart as shown in FIG. 5. An image formation signal is output (S411). Subsequently, the size of the paper, on which the image is to be formed, is determined (S412). When the paper, on which the image is to be formed, is determined to be of large size, the image formation is started immediately (S413). When the paper, on which the image is to be formed, is determined to be of small size, the transfer roller 7 is cooled (S414). Thereafter, the impedance of the transfer portion is measured (S415). When the impedance is not within the rang of 60 to 100 MΩ, the flow returns to S414, and the transfer roller 7 is cooled again. When the impedance is within the rang of 110 to 220 MΩ, the image formation is started immediately (S416). When the image formation is finished (S417), the transfer roller 7 is heated again (S418). Subsequently, the impedance of the transfer portion is measured (S419). When the impedance of the transfer portion is not within the rang of 60 to 110 MΩ, the flow returns to S418, and the transfer roller 7 is heated (S418). When the impedance of the transfer portion is within the rang of 60 to 110 MΩ, the image forming apparatus is set on standby.

In this manner, the image formation start timing is determined in response to the transfer material size, that is, the length of the transfer material in the direction orthogonal to the conveyance direction, and the detection result of the impedance of the transfer portion N.

Fifth Embodiment

In the present embodiment, a toner image primarily transferred to an intermediate transfer material 14 is secondarily transferred to a transfer material S with a secondary transfer roller 13. In the present embodiment, the temperature control operations of the transfer roller 7 in the above-described first to fourth embodiments are applied to the secondary transfer roller 13.

Figure 6:
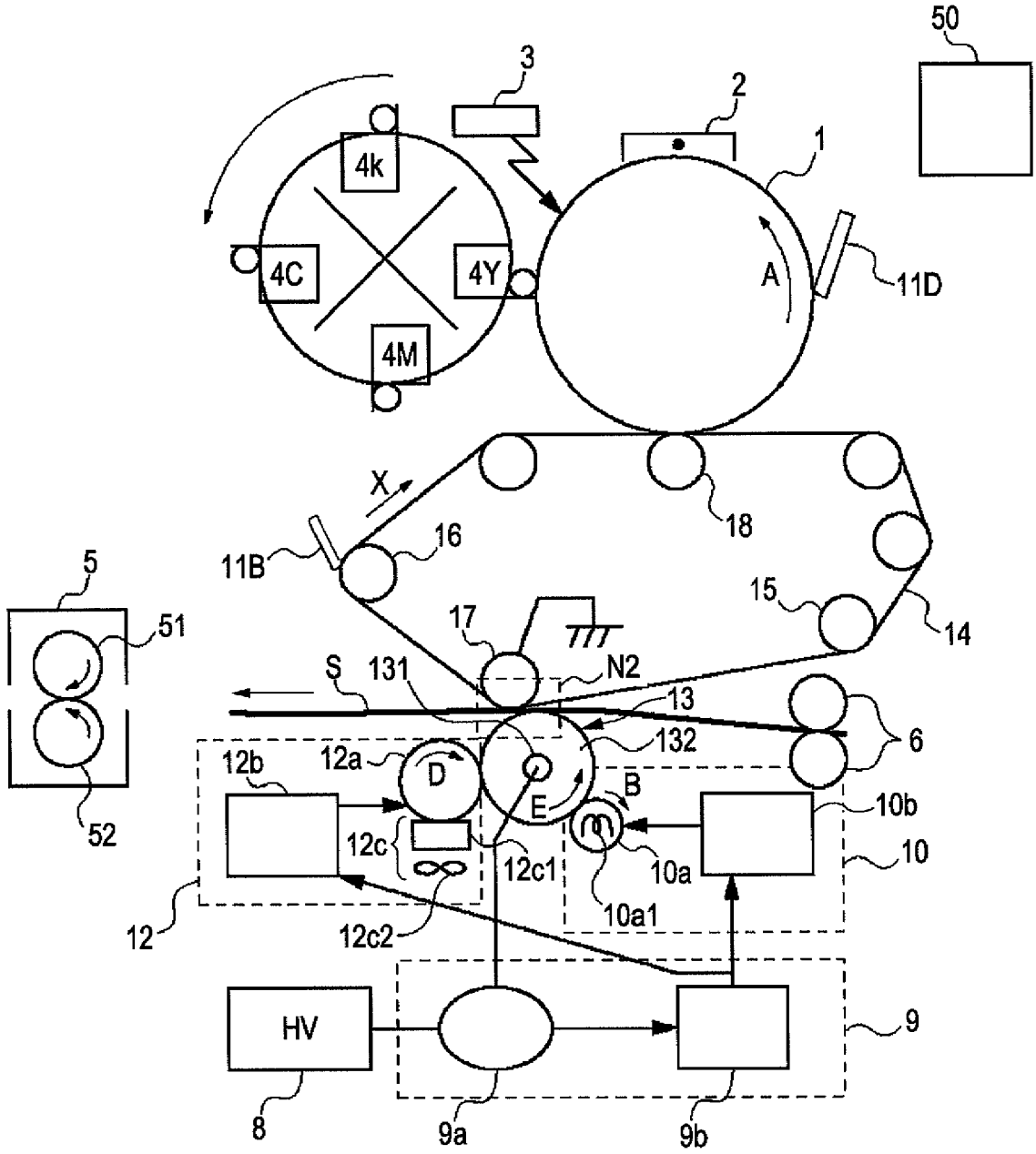
FIG. 6 is a schematic sectional view of an image forming apparatus according to a fifth embodiment.

The present embodiment will be described below with reference to FIG. 6. The members having the same configurations and operations as those in the above-described embodiments are indicated by the same reference numerals as those set forth above and explanations thereof will not be provided.

Reference numeral 1 denotes a photosensitive drum (photosensitive member) that rotates in the direction indicated by an arrow A. The surface thereof is uniformly charged by a charging apparatus 2. Reference numeral 3 denotes an exposure apparatus (electrostatic image forming unit) which performs exposure based on the image information. An electrostatic latent image in response to the image information is formed on the photosensitive drum 1 by a known electrophotographic process.

The developing apparatuses (developing units) 4Y, 4M, 4C, and 4*k* include yellow (Y), magenta (M), cyan (C), and black (k), respectively. The above-described electrostatic latent image is developed by these developing apparatuses 4Y, 4M, 4C, and 4*k* and, thereby, a toner image is formed on a surface of the photosensitive drum 1. A reversal development system, in which development is performed by adhering toner to the exposure portion of the electrostatic latent image, is used.

Reference numeral 14 denotes an intermediate transfer belt (image bearing member), which is disposed in contact with the surface of the photosensitive drum 1 and which is stretched over a plurality of stretching rollers so as to be rotated in the direction indicated by an arrow X. In the present embodiment, a stretching roller 15 is a tension roller for controlling the tension of the intermediate transfer belt 14 at a constant level, a stretching roller 16 is a driving roller of the intermediate transfer belt 14, and a stretching roller 17 is an opposing roller for secondary transfer.

In the present embodiment, for the intermediate transfer belt 14, resins, e.g., polyimide, polycarbonate, polyester, polypropylene, polyethylene terephthalate, acryl, and vinyl chloride or various types of rubber can be used. Furthermore, the belt to be used is allowed to include an appropriate amount of carbon black as an antistatic agent and have the volume resistivity of 1E+8 to 1E+13 Ω·cm and the thickness of 0.07 to 0.5 mm.

The intermediate transfer belt 14 has the shape of an endless belt and is disposed relative to the photosensitive drum 1. Each color of unfixed toner image, which is formed on a rotation of the intermediate transfer belt 14, on the photosensitive drum 1 is electrostatically and sequentially primarily transferred on the intermediate transfer belt 14 with a primary transfer roller (primary transfer member) 18. A full color image composed of superimposed unfixed toner images of four colors is produced on the intermediate transfer belt 14 through these steps. On the other hand, after each rotation of the photosensitive drum 1 for the primary transfer, the untransferred toner remaining on the surface of the photosensitive drum 1 is cleaned with a cleaning apparatus 11D. The step of forming the image is performed repeatedly. The above-described primary transfer roller 18 is disposed on the back surface side of the intermediate transfer belt 14 at a primary transfer position, at which the intermediate transfer belt 14 is opposed to the photosensitive drum 1. A positive primary transfer bias, which has the polarity opposite to the polarity of electrostatic charge of the toner, is applied to this primary transfer roller 18 and, thereby, the toner image on the photosensitive drum 1 is primarily transferred to the intermediate transfer belt 14.

In the present embodiment, at a secondary transfer position of the intermediate transfer belt 14 facing the conveying route of a transfer material S, a secondary transfer roller 13 is disposed while being press-contacted with the toner image bearing surface side of the intermediate transfer belt 14. In addition, a stretching roller 17, which serves as a counter electrode of the secondary transfer roller 13 and which is grounded, is disposed on the back surface side of the intermediate transfer belt 14. A bias having the polarity opposite to the polarity of the toner is applied to the secondary transfer roller (contact transfer member, secondary transfer member) 13 in contact with the intermediate transfer belt 14. In a secondary transfer portion N2, the toner image on the intermediate transfer belt 14 is secondarily transferred to the transfer material S. Furthermore, a belt cleaner 11B for cleaning the toner remaining on the intermediate transfer belt 14 after the secondary transfer is disposed on the downstream side from the secondary transfer portion.

In the present embodiment, the transfer material S is positioned and stopped once by a resist roller 6, and is conveyed to the secondary transfer portion N2 at a predetermined timing.

After secondary transfer, a conveying member (not shown in the drawing) conveys the transfer material S to a fuser 5 by where the toner is fused and adhered to the transfer material S.

The secondary transfer roller 13 has an outer diameter of about 16 mm and is composed of a metal core bar 131 having an outer diameter of about 8 mm and an electroconductive material layer 132, which is an elastic layer and is disposed on the peripheral surface of the core bar. A polymer elastomer or a polymer foam material, e.g., rubber or urethane, can be used as a base material of this electroconductive material layer 132. The electroconductivity of this electroconductive material layer 132 is adjusted in a middle resistance region of 1 MΩ to 100 MΩ by blending an ionic electroconductive material therein.

In using urethane as the base material of the above-described electroconductive material layer 132, polyol can be used for preparing general soft polyurethane foam or urethane elastomer can be used as a polyhydroxyl compound.

That is, examples thereof include polyether polyol, polyester polyol, each having a polyhydroxyl group at a terminal, and polyether polyol produced by copolymerization of the two. Furthermore, general polyols, e.g., so-called polymer polyols produced by polymerization of ethylenic unsaturated monomer in polyol, can be used. For a polyisocyanate compound, polyisocyanate similarly used for preparing general soft polyurethane foam or urethane elastomer can be used. That is, examples thereof include tolylene diisocyanate (TDI), crude TDI, and 4,4-diphenylmethane diisocyanate (MDI). Furthermore, crude MDI and aliphatic polyisocyanate having the carbon number of 2 to 18 can be used. Alternatively, alicyclic polyisocyanate having the carbon number of 4 to 15 and mixtures or modified products of these polyisocyanates, for example, prepolymers produced by a partial reaction with polyols, can be used. For the rubber used as the base material of the above-described electroconductive material layer, natural rubber, nitrile butadiene rubber, chloroprene rubber, or styrene butadiene rubber can be used. Furthermore, common rubber, e.g., butadiene rubber, ethylene propylene rubber, isoprene rubber, or polynorbornene rubber, can be used. Alternatively, thermoplastic rubber, e.g., styrene-butadiene-styrene (SBS) or a hydrogenated product of styrene-butadiene-styrene (SEBS), can be used. Liquid polyisoprene rubber can also be blended into the above-described rubber. In addition, a foamed product of, for example, copolymerization rubber of the above-described rubber or epichlorohydrin and ethylene oxide can also be used. Examples of ionic electroconductive materials added to the base materials include inorganic ionic electroconductive materials, e.g., sodium perchlorate, calcium perchlorate, and sodium chloride. Furthermore, examples thereof include organic ionic electroconductive materials, e.g., modified aliphatic dimethylethyl ammonium ethosulfate, stearylammonium acetate, laurylammonium acetate, and octadecyltrimethylammonium perchlorate. In general, sodium perchlorate is frequently used.

A metal roller 10*a*, which is a constituent member of a heating portion 10 for heating the secondary transfer roller 13, has a cylindrical shape and is driven to rotate by the secondary transfer roller 13 in a direction indicated by an arrow B.

The metal roller 10*a* is heated to 0 to 45° C. by a halogen lamp heater 10*a*1 in the cylinder. Both end portions of the metal roller 10*a* are supported by insulating members formed from polyoxymethylene (POM) or the like.

The metal roller 10*a* is formed to have the same length as the length of the electroconductive material layer 132 of the secondary transfer roller 13, and the POM support members at both end portions are energized toward the secondary transfer roller 13 by contact units (not shown in the drawing). At this time, a load of 200 g is imposed on each side in such a way that the contact pressure relative to the secondary transfer roller 13 becomes uniform in a longitudinal direction thereof.

The metal roller 10*a* is driven to rotate in a direction indicated by the arrow B by the rotation of the secondary transfer roller 13. The turning on and turning off of the above-described halogen lamp heater 10*a*1 are repeated by a heating controller 10*b* and, thereby, the temperature of the metal roller 10*a* can be changed. The material of the metal roller 10*a* is not limited to aluminum, but may be other arbitrary metals (for example, copper), as long as the metal has a high thermal conductivity. The material for the shaft flange is not simply limited to POM, but may be any material, for example, a mixed material of nylon and glass, as long as the material has an insulating property.

An output detection portion 9 of the transfer power supply 8 detects a current by a current detector 9*a* when the transfer material S is not conveyed. This is carried out eight (8) times per rotation of the secondary transfer roller 13, and the eight results of current detection are averaged by an arithmetic apparatus 9*b*. Subsequently, an impedance I of the second transfer portion N2 is calculated. The temperature of the metal roller 10*a* is controlled by controlling the turning on and the turning off of the halogen lamp heater 10*a*1 with the above-described heating controller 10*b* in such a way that the impedance I becomes 60 to 100 MΩ. This impedance I is for preventing occurrence of a poor image even when the conveying speed of normal paper is set at 260 mm/sec.

The transfer bias (output) by the transfer power supply 8 is constant-voltage controlled in such a way that 40 to 70 μA of current passes when normal paper with no toner image passes through the secondary transfer portion in a temperature and humidity environment of 23° C. and 50%.

A metal roller 12*a*, which is a constituent member of a cooling portion 12 for cooling the secondary transfer roller 13, has a cylindrical shape and is driven to rotate by the secondary transfer roller 13. The metal roller 12*a* is cooled to 0 to 10° C. from the outside by an air-cooled type cooling control member 12*c* including a Peltier element 12*c*1 and a fan 12*c*2.

Both end portions of the metal roller 12*a* are supported by insulating members formed from polyoxymethylene (POM) or the like.

The metal roller 12*a* is formed to have the same length as the length of the electroconductive material layer 132 of the secondary transfer roller 13, and the POM support members at both end portions are energized toward the secondary transfer roller 13 by contact units (not shown in the drawing). At this time, a load of 200 g is imposed on each side in such a way that the contact pressure relative to the secondary transfer roller 13 becomes uniform in a longitudinal direction thereof.

The metal roller 12*a* is driven to rotate in a direction indicated by the arrow D by the rotation of the secondary transfer roller 13. The temperature of the metal roller 12*a* can be changed by repeating ON/OFF of the Peltier element 12*c*1 and the fan 12*c*2 based on input signals into the above-described cooling controller 12*b*. The material of the metal roller 12*a* is not limited to aluminum, but may be other arbitrary metals (for example, copper), as long as the metal has a high thermal conductivity. The material for the shaft flange is not simply limited to POM, but may be any material, for example, a mixed material of nylon and glass, as long as the material has an insulating property.

An output detection portion 9 of the transfer power supply 8 detects a current passing the secondary transfer roller 13 by a current detector 9*a* when a voltage of +1 KV, which is a monitor voltage, is applied to the secondary transfer roller 13 in the state in which the transfer material S is not conveyed. This is carried out eight (8) times per rotation of the secondary transfer roller 13, and the eight results of current detection are averaged by an arithmetic apparatus 9*b*. Subsequently, an impedance I of the secondary transfer portion N2 is calculated by dividing the value of the monitor voltage by the current detection result.

The temperature of the metal roller 12*a* is controlled by controlling the ON/OFF of the Peltier element and the fan with the above-described cooling control member 12*c* in such a way that the impedance I becomes 110 to 220 MΩ.

This value of impedance I is for preventing occurrence of a poor image at a front end and a rear end of specialty paper when the specialty paper is conveyed at a conveying speed of 130 mm/sec.

The transfer bias (output) by the transfer power supply 8 is constant-voltage controlled in such a way that 15 to 30 μA of current passes when specialty paper with no toner image passes through the secondary transfer portion N2 in a temperature and humidity environment of 23° C. and 50%.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-370165 filed Dec. 22, 2005, which is hereby incorporated by reference herein in its entirety.

What is claimed is:

1. An image forming apparatus comprising:

an image bearing member configured to bear a toner image;

a transfer member having a temperature-dependent resistance value and being pressed against the image bearing member, the transfer member being applied with a voltage so as to transfer the toner image on the image bearing member to a transfer material; and a resistance value changing unit configured to heat or cool the transfer member in such a way that the resistance value of the transfer member is changed in accordance with the type of the transfer material, wherein the resistance value changing unit decreases the temperature of the transfer member so as to increase the resistance value of the transfer member, in accordance with the thickness of the transfer material being increased.

2. The image forming apparatus according to claim 1, wherein the resistance value changing unit comprises:

a cooling member contacting the transfer member so as to cool the transfer member; and a heating member contacting the transfer member so as to heat the transfer member.

3. The image forming apparatus according to claim 1, wherein the resistance value changing unit decreases the temperature of the transfer member so as to increase the resistance value of the transfer member, in accordance with the length of the transfer material being decreased in a direction orthogonal to a direction of movement of the transfer material when the toner image is transferred.

4. The image forming apparatus according to claim 3, wherein the resistance value changing unit comprises:

a cooling member contacting the transfer member so as to cool the transfer member; and a heating member contacting the transfer member so as to heat the transfer member.

* * * * *